United States Patent [19]

Johnson, Jr.

[11] Patent Number: 5,076,574

[45] Date of Patent: Dec. 31, 1991

[54] ROPE CLIMBING EXERCISE APPARATUS

[76] Inventor: Raymond Johnson, Jr., P.O. Box 1504, New Brunswick, N.J. 08903

[21] Appl. No.: 567,122

[22] Filed: Aug. 13, 1990

[51] Int. Cl.[5] ..... A63B 7/04

[52] U.S. Cl. ..... 272/112; 272/130

[58] Field of Search ..... 272/112, 134, 130

[56] References Cited

U.S. PATENT DOCUMENTS 3,599,974 8/1971 Price ..... 272/134

3,782,718 1/1974 Saylor ..... 272/112

*Primary Examiner*—Richard J. Apley

*Assistant Examiner*—Glenn E. Richman

*Attorney, Agent, or Firm*—Joel F. Spivak

[57] ABSTRACT

A portable, stable motorless rope-climbing exercise machine comprises a stable support frame, a plurality of rope pulleys and rope guides mounted on the frame, an endless rope extending around the pulleys and guides to form a path which includes a vertically extending rope climbing portion, and hydraulic braking assembly coupled to the pulley system for controlling the rate of movement of the rope based upon the weight of the user when said user is climbing the rope.

6 Claims, 1 Drawing Sheet

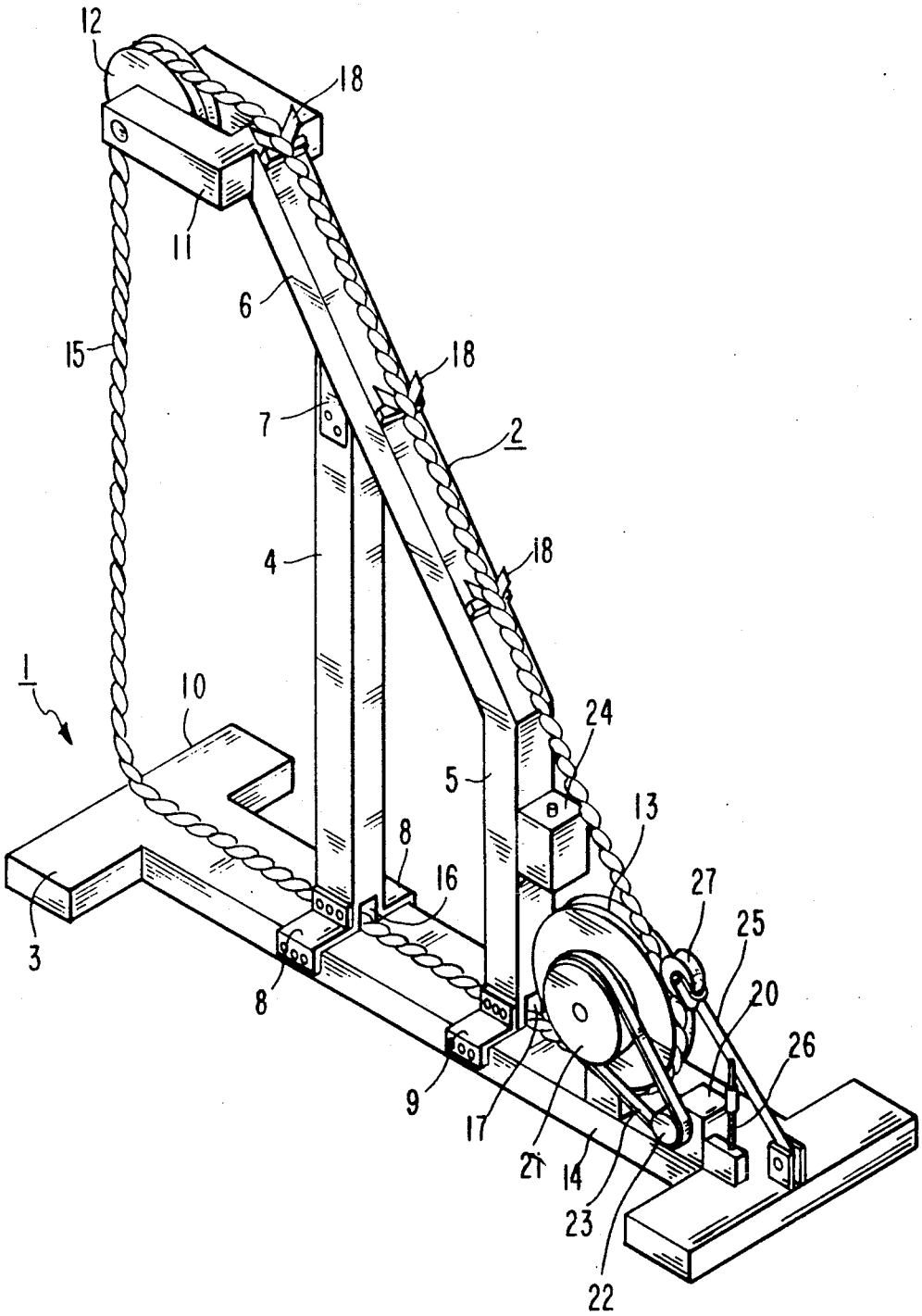
12
18
11
6
15
18
7
2
4
18
1
10
24
5
13
8
16
27
25
3
8
20
26
9
17
21
14
23
22

ROPE CLIMBING EXERCISE APPARATUS

BACKGROUND OF THE INVENTION

1. Field of the Invention

The invention relates to an improved exercise device and more particularly, to rope-climbing equipment.

2. Description of the Prior Art

High school and college students are generally required to participate in various gymnastic exercises as part of their overall curriculum, among these exercises is rope-climbing. Further, increasing numbers of the general public now participate in various health, body building and toning exercises via Health Clubs. However, noticeably absent from the available exercise equipment in such clubs, is rope-climbing apparatus. The predominant reason for this absence is the possibility of bodily injury and liability associated therewith using conventional rope-climbing equipment.

Climbing ropes of the type customarily employed in gymnasiums are stationary hanging ropes which are suspended from one end from a ceiling fixture high above the gym floor. A climber who froze, slipped or othewise fell from the top of such a rope could sustain severe injury. Also, rope burns are common in using such apparatus.

Alternative rope-climbing apparatus has been suggested, but due to various limitations have never been implemented. For example, in U.S. Pat. No. 641,519 an exercise apparatus comprising an endless rope combined with an adjustable friction device to vary the strength required to pull the rope is taught. Although such a device is suitable for exercising the arms and upper body, the exerciser, at all time, remains with his feet on the floor and thus cannot simulate or obtain the full benefit of actual rope climbing.

In accordance with U.S. Pat. No. 3,782,718, a power operated endless rope is moved continuously at a selected predetermined speed, either up or down, to allow a climber to climb up or down on the rope while remaining safely close to the floor. The rope is supported in a cantilevered manner on a wall or other.superstructure, normally at least 10 feet above the floor. A variable speed, reversible electric motor controls movement of the rope. The rope is routed through a tortious path of pulleys and rubber coated surfaces in order to prevent rope slippage. This device is limited due to its need for electric power and its need for mounting to a superstructure such as a wall or ceiling. Also, although the height above the floor during use is limited and injury may not occur due to the operator failing to hold on to the rope, injury could occur if the operator fails to reach the control for reversing the electric motor. Hence, safety is still in question when using this device.

SUMMARY OF THE INVENTION

A motorless, portable, rope-climbing exercise apparatus comprises (1) a free standing, stable self-supporting frame comprising (a) an elongated support base member (b) at least one vertical member extending upwardly from and secured to the base and (c) a diagonal member supported by at least one vertical member and either at least one other vertical member or said base, the three members forming a generally right triangular configuration;

(2) a plurality of rope guide pulleys including at least a first pulley attached to the upper end of the diagonal member and a second rope guide pulley attached near the rear of the base member;

(3) means for guiding a rope along the length of the support base member;

(4) an endless loop rope extending around the rope guide pulleys and rope guiding means in a manner to include a vertical rope portion extending downwardly from the first pulley to the base member; and (5) hydraulic rope speed control means associated with at least one of said pulleys.

The apparatus also preferably includes rope tensioning means for insuring the proper tension on the rope.

BRIEF DESCRIPTION OF THE DRAWINGS

The FIGURE is an isometric view of an embodiment of the invention.

DETAILED DESCRIPTION OF THE INVENTION

The present invention provides a rope climb exercise machine which is simple in design, insures the safety of the operator during off the ground, hand-over-hand rope climbing exercise, is motorless and therefore obviates the need for electrical power and is portable and does not require wall or ceiling or other permanent type mounting. Further, since the rope area is unencumbered, the user may use hands only or feet and hands while remaining a safe distance from the ground in case of a slip and for easy quick dismount. Also, the user is automatically slowly lowered to the ground due to his own weight when he stops the exercise, thereby eliminating the need for a reversing motor or mechanism. Additionally the hydraulic speed control-braking mechanism can be made adjustable so as to allow the user to automatically preset a climb rate range within safe limits.

It should be understood from the outset that the invention is not limited to the specific embodiment shown. For example, the shape of the support frame, the placement and type of pulleys and/or rope guide means, height of the apparatus and placement of hydraulic speed control means and rope tensioning means may be varied provided the end result is within the concept disclosed herein and summarized above.

Referring now to the Figure there is shown a rope climbing exercise apparatus 1 which is of such dimension so as to allow the user to simulate hand-over-hand rope climbing at a safe distance from the floor. The apparatus comprises a free standing, stable, self supporting frame 2 which consists of an I-shaped horizontal base member 3, a first vertical support member 4 mounted to and extending upwardly from the base member 3, a second vertical support member 5 spaced from the first vertical member 4 and which is mounted to the base member 3 and extending upwardly therefrom. The second vertical support member 5 is the lower portion of a diagonal member 6 which extends diagonally upwardly from the top of the second vertical member 5 and is coupled to the top of the first vertical support member 4 by means of a mounting bracket 7. Mounting brackets 8 and 9 respectively secure the first and second vertical members 4 and 5 to the base member 3. The first vertical support member 4 is displaced rearwardly from the front 10 of the base 3 the diagonal member 6 extends upwardly beyond the first vertical support member 4 and terminates in a horizontal forked end portion 11 which terminates essentially over the vicinity of the front end 10 of the base member 3. The general shape of the frame 2 is therefore triangular, as shown.

It should be understood that the base should be of such dimensions that the apparatus will be stable without the need for mounting. However, if desired, to insure further stability or merely to prevent unwanted movement of the apparatus by unauthorized persons, the base may optionally be mounted to the floor. Further, while the vertical members, as shown, are perpendicular to the base, it should be understood that other designs, such as where the vertical members are not at right angles to the base is contemplated and the terms 'vertical' or 'vertically extending' as used herein includes members not at right angles to the base member.

The apparatus, as shown, includes a first rope guide pulley 12 mounted at the forked end of the horizontal portion 11 of the diagonal member 6 and a second rope guide pulley 13 mounted to the rear portion 14 of the base 3 rear of and adjacent to the second vertical member 5.

Additional rope guide means i.e. in addition to the pulleys, for guiding an endless loop rope 15 along its path are also provided. More specifically, the vertical member 4 and 5 are provided with channels 16 and 17 respectively, at their respective lower ends. To insure that the rope is not abraded when passing through the channels, one may provide low friction surface means within the channels, if desired, upon which the rope moves. Additional spaced rope guides are provided on the diagonal member 6. These may take the form of small stand-off pulley guides or, as shown, simple Y-shaped nylon guides 18 which keep the rope from being abraded by the support member by raising it from the surface of the member 6.

The apparatus 1 further includes a hydraulic braking or speed control pump 20 mounted to the base and coupled to the second rope guide pulley 13 by means of a pair of pulleys 21 and 22 coupled to each other by a pulley belt or chain 23 wherein one pulley e.g. pulley 22 is coupled directly to the hydraulic pump 20 and the other pulley 21 is coupled to the rope guide pulley 13. Preferably, the hydraulic force of the hydraulic control means 20 is of the type that can be adjusted so that the user can thereby adjust the rate of movement of the rope for his or her weight and exercise speed. It is also preferable to include a hydraulic reserve reservoir 24 which may be mounted to the second vertical member 5 and an adjustable rope tensioning means 25 which is mounted at the rear of the base 3 and is adjustable by means of a screw portion 26 which raises or lowers a tensioner pulley 27 so as to adjust the tension of the rope to reduce slack.

The endless rope 15 passes over the rope guide pulleys 12 and 13 and the nylon rope guides 18 through the rope guide channels 16 and 17. The rope 15 has a vertically hanging portion extending downwardly from the pulley 12 to the front of the base 3 where the user grasps the rope for hand-over-hand climbing.

In operation, the user sets the braking force applied by the hydraulic pump so as to adjust the apparatus to his or her liking. Preferably, the hydraulic adjustment is precalibrated for various weights so that the user can dial-in the adjustment for his/her weight to attain a standard rope speed. The user then, standing in front of the apparatus grasps the rope in a hand-over-hand motion and climbs the rope. As the user climbs the rope his or her weight pulls the rope downwardly at the rate controlled by the braking force applied to the pulley system by the hydraulic pump. If the user tends to go faster, in his/her hand-over-hand movement, the user will ascend the rope, if the user slows down or stops the hand-over-hand rope climbing movement the user will automatically and safely descend in a slow, controlled manner. The height above the ground that the user can ascend is limited by the height of the vertical portion of the rope, typically 7–10 feet and controlled by the users speed in hand-over-hand climbing. If the user desires to simulate faster climbing speed without ascending the rope to its full height, he/she need only reduce the hydraulic force which retards the free turning of the lower rope pulley to which it is coupled. Similarly, if the user wishes to slow down the climbing speed necessary to maintain a given height above the ground for that users weight, he/she need only increase the hydraulic force retarding the rope pulley system.

Hence, a simple, stable, portable, safe, motorless and adjustable apparatus is provided.

What is claimed is:

1. A motorless, portable rope-climbing exercise apparatus comprising (a) free standing, stable, self supporting frame comprising (i) an elongated support base member (ii) at least one vertical member extending upwardly from and secured to the base and (iii) a diagonal member supported by at least one vertical member and either at least one other vertical member or said base;

(b) a plurality of rope guide pulleys including at least a first pulley attached to the upper end of the diagonal member and substantially laterally displaced from said vertical member supporting said diagonal member and a second rope guide pulley attached near the rear of the base member;

(c) means for guiding a rope along a predetermined path about the apparatus;

(d) an endless loop rope extending around the rope guide pullies and rope guiding means in a manner such as the rope path includes a vertical rope portion extending downwardly from the first pulley to the base member such that said vertical portion is unencumbered by and does not terminate at said second rope guide pulley, followed by an extended horizontal portion going to the second pulley; and (e) hydraulic rope speed control means associated with at least one of said pulleys.

2. A portable, stable, motorless rope-climbing exercise machine comprises a stable support frame having an elongated base, a diagonal member and at least one vertical member supporting said diagonal member, a plurality of rope pulleys and guides mounted on the frame, an endless rope extending around the pulleys and guides to form a path which includes a vertically extending rope climbing portion followed by a horizontally extending rope portion which extends along said base member and a diagonally extending rope portion extending along said diagonal member, and hydraulic means coupled to the pulley system for controlling the rate of movement of the rope based upon the weight of the user when said user is climbing the rope.

3. The apparatus recited in claim 1 wherein the pressure from the hydraulic speed control means is adjustable.

4. The apparatus of claim 3 wherein the hydraulic speed control means is precalibrated based upon the weight of the user.

5. The apparatus recited in claim 3 wherein the rope passes through rope guide channels provided at the base of the vertical members such that said rope path consists of a vertical portion, followed by an elongated horizontal portion along the base of the apparatus and a diagonal portion between the rope pullies.

6. The apparatus recited in claim 1 further including rope tensioning means.

* * * * *